US006484444B1

(12) United States Patent
Polowinczak

(10) Patent No.: US 6,484,444 B1
(45) Date of Patent: Nov. 26, 2002

(54) STOP FOR A SLIDABLE WINDOW

(75) Inventor: Allen D. Polowinczak, Plainfield, IL (US)

(73) Assignee: Ashland Products, Inc., Lowell, IN (US)

( * ) Notice: Subject to any disclaimer, the term of this patent is extended or adjusted under 35 U.S.C. 154(b) by 0 days.

(21) Appl. No.: 09/713,159

(22) Filed: Nov. 14, 2000

(51) Int. Cl.[7] ..... E05B 55/00
(52) U.S. Cl. ..... 49/449
(58) Field of Search ..... 49/183, 184, 186, 49/407, 175, 449, 404

(56) References Cited

U.S. PATENT DOCUMENTS

| | | | |
|---|---|---|---|
| 16,228 | A | 12/1856 | Copeland |
| 163,008 | A | 5/1875 | Gillespie et al. |
| 190,074 | A | 4/1877 | Penfield |
| 357,116 | A | 2/1887 | Coultaus |
| 416,681 | A | 12/1889 | Krom |
| 534,185 | A | 2/1895 | Winchester |
| 666,596 | A | 1/1901 | Breen |
| 756,453 | A | 4/1904 | Arens et al. |
| 976,777 | A | 11/1910 | Brown |
| 1,261,274 | A | 4/1918 | Newsam |
| 1,388,272 | A | 8/1921 | Lawrence |
| 1,866,233 | A | 7/1932 | Tarrant |
| 1,895,146 | A | 1/1933 | Brown |
| 1,940,084 | A | 12/1933 | Grasso |
| 2,249,132 | A | 7/1941 | Haslam |
| 2,850,312 | A | 9/1958 | Rifkin |
| 2,950,136 | A | 8/1960 | Pengelly |
| 3,021,163 | A | 2/1962 | Hoffman |
| 3,330,585 | A | 7/1967 | Pollin |
| 4,095,827 | A | 6/1978 | Stavenau |
| 4,110,867 | A | 9/1978 | Gwozdz |
| 4,274,666 | A | 6/1981 | Peck |
| 4,303,266 | A | 12/1981 | Volpi |
| 4,400,026 | A | 8/1983 | Brown, Jr. |
| 4,462,623 | A | 7/1984 | Grant |
| 4,553,353 | A | 11/1985 | Simpson |
| 4,578,903 | A | 4/1986 | Simpson |
| 4,682,455 | A | 7/1987 | Klompenburg |
| 4,721,332 | A | 1/1988 | Sturman |
| 4,797,970 | A | 1/1989 | Charlton |
| 4,813,725 | A | 3/1989 | Mosch |
| 4,824,154 | A | 4/1989 | Simpson |
| 4,917,416 | A | 4/1990 | Westphal et al. |
| 4,923,230 | A | 5/1990 | Simpson |
| 4,932,694 | A | 6/1990 | Cater, Sr. |

(List continued on next page.)

FOREIGN PATENT DOCUMENTS

| | | |
|---|---|---|
| CA | 1316965 | 4/1993 |
| DE | 1584058 | 10/1966 |
| GB | 2056540 | 3/1981 |

*Primary Examiner*—Jerry Redman
(74) *Attorney, Agent, or Firm*—Wallenstein & Wagner, Ltd.

(57) ABSTRACT

A window stop (10) for limiting movement of a sliding window along a predetermined path of window movement is provided. The window stop (10) has a housing (12) having a cavity (20) wherein the housing (12) is adapted to be positioned adjacent the path of window movement. A bolt (14), operatively associated with the cavity (20), is moveable between a first position (BP1) within the housing (12) and thereby out of the path of window movement, and a second position (BP2) extending out of the housing (12) into the path of the window movement whereby the window is able to contact the bolt (14). A securing element (16) exerts a force generally perpendicular to the longitudinal axis of the housing and on the bolt (14) to retain the bolt at the first position (BP1). When a second force is applied to overcome the force exerted by the securing element (16), a biasing element (18) displaces the bolt (14) toward the second position (BP2). The bolt (14) receives forces from the window contacting the extended bolt (14), and the forces are distributed throughout the housing (12).

15 Claims, 5 Drawing Sheets

U.S. PATENT DOCUMENTS 5,018,241 A 5/1991 Baines
5,083,398 A 1/1992 Kolbeck et al.
5,096,240 A 3/1992 Schultz
5,110,165 A 5/1992 Piltingsrud
5,165,737 A 11/1992 Riegelman
5,248,174 A 9/1993 Matz et al.
5,492,377 A 2/1996 Guelck
5,536,052 A 7/1996 Maier
5,553,903 A 9/1996 Prete et al.
5,575,116 A * 11/1996 Carlson et al. ..... 49/449
5,582,445 A 12/1996 Olsen et al.
5,653,485 A 8/1997 Campbell
5,806,900 A 9/1998 Bratcher et al.

* cited by examiner

STOP FOR A SLIDABLE WINDOW

TECHNICAL FIELD

This invention relates generally to a device for selectively limiting the movement of a sliding member and more particularly concerns a window stop for selectively limiting the movement of a window that slides either horizontally or vertically along a track.

BACKGROUND

Sliding window assemblies often include a pair of window sashes. One assembly is commonly referred to as a double-hung sash window. A double-hung window typically includes a window frame and a pair of window sashes mounted for vertical sliding movement, one relative to the other, within the window frame. Another window assembly may generally be referred to as a horizontal sliding window. A horizontal sliding window also includes a window frame and pair of window sashes mounted for lateral sliding movement, one relative to the other, within the window frame. Although window assemblies traditionally have been made exclusively of wood, window assemblies are increasingly being formed of extruded plastic or metal frame members which are joined at mitered corners, to form a generally rectangular frame in which glazing is mounted. Examples of these types of window assemblies are shown in FIGS. 1 and 2.

In these window assemblies, it is important to be able to selectively limit the distance the sliding window sash may travel. For example, a window sash may be partially opened, enough to allow for venting, while still inhibiting egress in or out through the window.

To selectively limit the movement of the sliding window sash, window stops have been developed. One type of window stop is shown in U.S. Pat. Nos. 4,824,154; 4,923,230 and 5,248,174, having the same assignee as the present invention. This window stop is a compact unit typically mounted in a stile of a window frame (See FIG. 1). The window stop generally includes a tumbler within a housing. The tumbler rotates out of the housing and extends into the path of a sliding window sash thus limiting movement of the sash. While this window stop has been very effective in this application, the amount of force that the tumbler can absorb is limited. In some applications, too much force can be delivered from the sliding window. The high impact of the sliding window against the stop causes the tumbler to over-rotate, sometimes breaking the window stop.

A second type of window stop is shown in U.S. Pat. No. 5,553,903, having the same assignee as the present invention. This window stop can be mounted in a track of a sliding window (See FIG. 2) and can also be mounted in a stile of a window frame like the stop shown in FIG. 1. This window stop generally includes a bolt and latch within a housing. By operating the latch, the bolt extends directly out of the housing into the path of a sliding window sash, thus limiting movement of the sash. The bolt does not rotate out of the housing. This second window stop has guides between the housing and bolt that increases the resistive areas over which forces may be transferred. Consequently, this window stop can absorb greater forces than the window stop having the rotating tumbler. Because the window stop housing has separate cavities to accommodate the latch and bolt, however, the stop is not as compact in size as the present invention. In addition, the second window stop is more costly than the window stop having the rotating tumbler.

A third type of window stop is shown in U.S. Pat. No. 5,806,900, having he same assignee as the present invention. This window stop has a housing with a cavity, a bolt within the housing, and an actuator allowing the bolt to extend from a first position to a second position. The actuator has multiple depending structures and is fixed to the bolt with a pin. To extend the bolt, a user rotates the actuator. The actuator is a separate structural element that is carried by the bolt. This window stop typically requires a deeper housing than is required for window stops using a rotating tumbler.

In certain window stop applications, the direction a user must apply a force to actuate the tumbler or bolt is the same direction in which a window slides along a track. In certain instances, sliding the window over the window stop can inadvertently actuate the window stop. This situation can damage both the stop and the window. Because the path of window movement is equivalent to the direction of force applied to the actuator for actuation, inadvertent actuation can occur. In other words, the movement of the window along its path can unexpectedly activate the actuator and deploy the bolt. The present invention is provided to solve these and other problems.

SUMMARY OF THE INVENTION

The present invention relates to a window stop for limiting movement of a sliding window along a predetermined path of window movement. Besides use with sliding windows, however, the invention could also be used to limit movement of a number of different sliding members. According to a first aspect of the invention, the window stop has a housing having a cavity. The housing is adapted to be positioned adjacent and parallel to the path of window movement. A bolt is operatively associated with the cavity and moveable between a first position within the housing and thereby out of the path of window movement, and a second position extending out of the housing into the path of the window movement whereby the window is able to contact the bolt. A means for securing the bolt in the first position exerts a force on the bolt in a direction generally perpendicular to a longitudinal axis of the housing. A biasing means displaces the bolt towards its second position when a second force is applied to the bolt and that force exceeds the force exerted by the securing means. The bolt receives forces from contact with the sliding window when the bolt is in its second position.

According to another aspect of the invention an upper portion of the bolt has a ledge, and an upper portion of the housing has a lip. At the first position, the securing means applies a force to a surface of the bolt to retain the bolt while the lip engages the ledge.

According to another aspect of the invention, the bolt and housing have engaging surfaces comprising a tongue and groove arrangement. The tongue is located either on the bolt or the housing and a cooperating groove is located either on the housing or bolt to absorb and transfer forces between the window, bolt, and housing.

According to a further aspect of the invention, the stop includes a means for fastening the stop in an opening in a window stile. The fastening means extend upwardly from a side wall of the housing to engage the opening in the window stile where the stop is to be installed.

According to another aspect of the invention, the bolt has an indicia on an upper surface indicating that force must be applied in a direction generally transverse to the longitudinal axis of the housing to release the bolt from the first position.

Other features and advantages of the invention will be apparent from the following specification taken in conjunction with the following drawings.

DETAILED DESCRIPTION OF THE INVENTION

Figure 1:
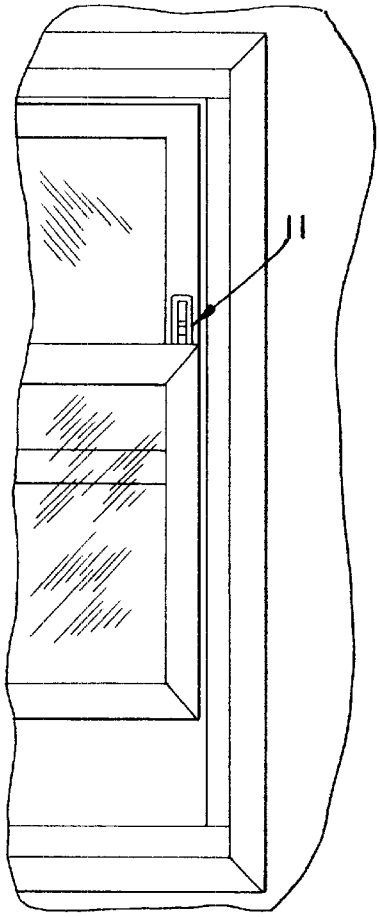
FIG. 1 PRIOR ART
FIG. 1 is a fragmentary front elevation view of a double-hung window assembly depicting a prior art window stop installed in an upper stile of a window frame.
Figure 2:
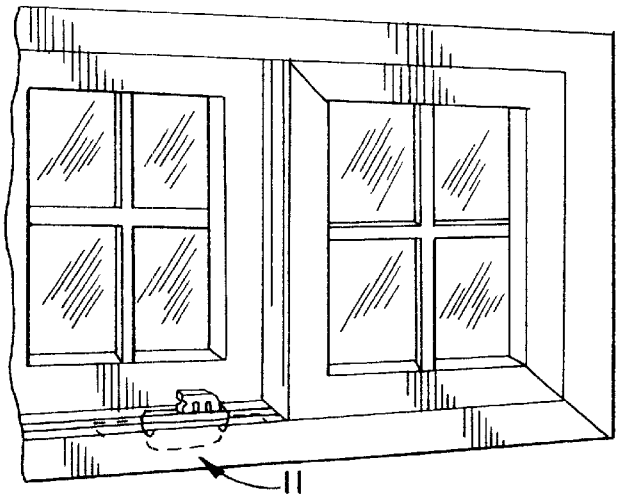
FIG. 2 PRIOR ART
FIG. 2 is a fragmentary perspective view of a sliding window assembly depicting another prior art window stop installed in a window track of a window frame.

While this invention is susceptible of embodiments in many different forms, there is shown in the drawings and will herein be described in detail, a preferred embodiment of the invention with the understanding that the present disclosure is to be considered as an exemplification of the principles of the invention and is not intended to limit the broad aspects of the invention to the embodiment illustrated.

Figure 3:
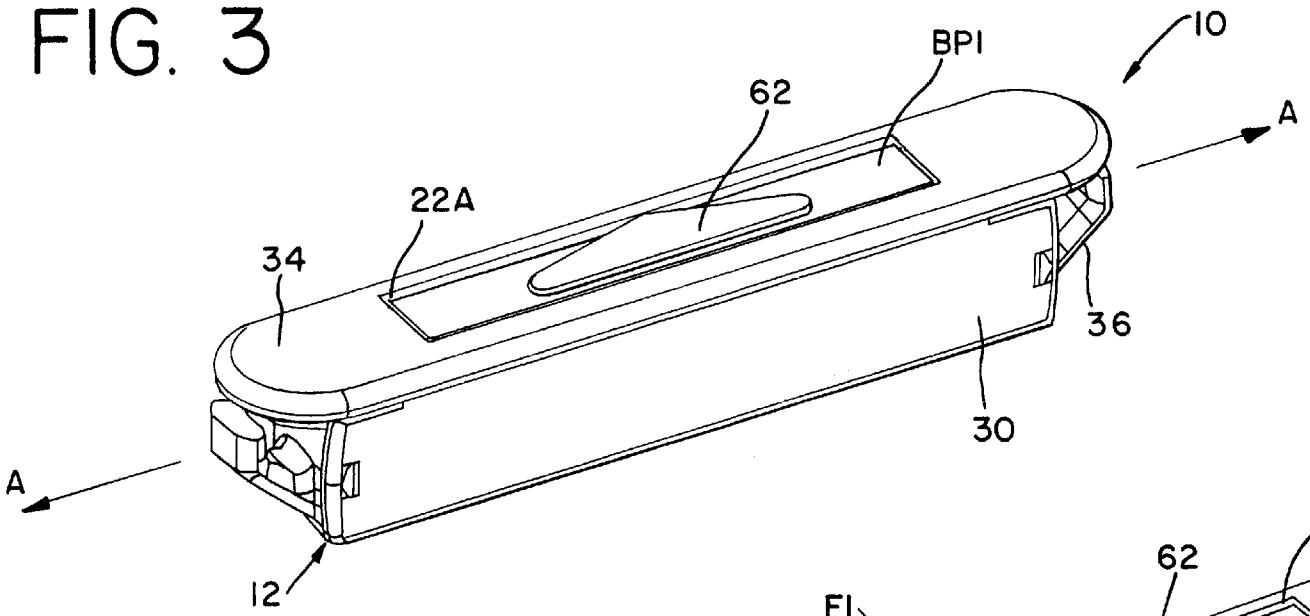
FIG. 3 is a perspective view of an embodiment of a window stop of the present invention showing a housing, a cover plate, and a bolt in a first position.

Referring to the drawings, FIG. 3 shows a window stop of the present invention generally designated by the reference numeral 10. The window stop 10 generally includes a housing 12, and a bolt 14. The housing 12 is installed into a window track or sash stile in a position generally parallel to the path of movement of a sliding window. The bolt 14 is moveable between a first position BP1 (recessed within housing 12) (FIG. 3), out of the path of window movement, and a second position BP2 (extending out of the housing 12) (FIG. 5), into the path of window movement. When the bolt 12 is deployed in its second position, BP2, the stop 10 limits the movement of the window along the path of movement. The structure and assembly of the window stop 10 will first be described and then the installation and operation of the window stop 10 will be described.

Structure And Assembly

Figure 6:
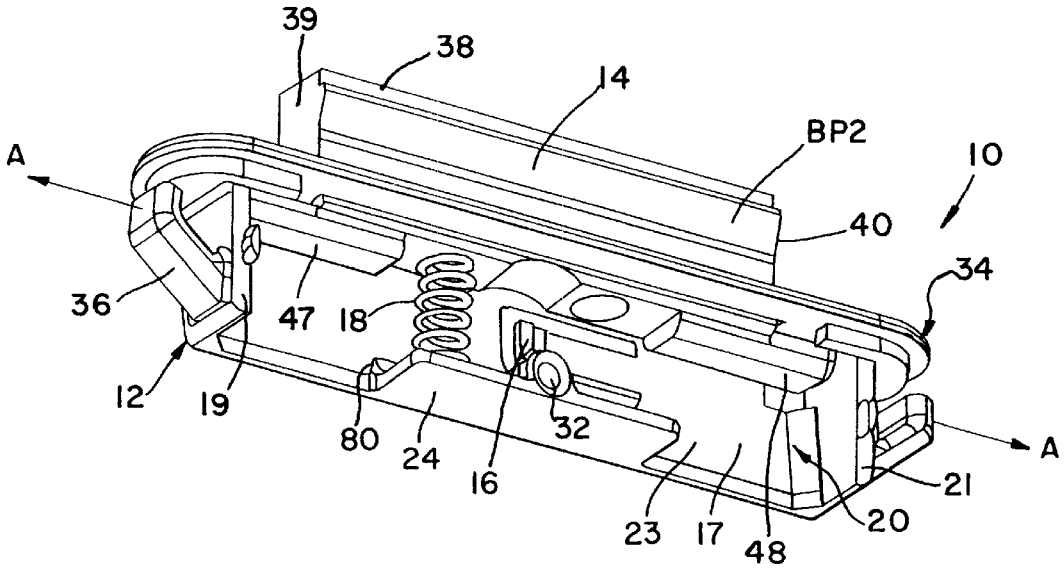
FIG. 6 is a perspective view of the window stop of FIG. 3 showing the housing, an internal cavity of the housing, and the bolt in the second position.
Figure 7:
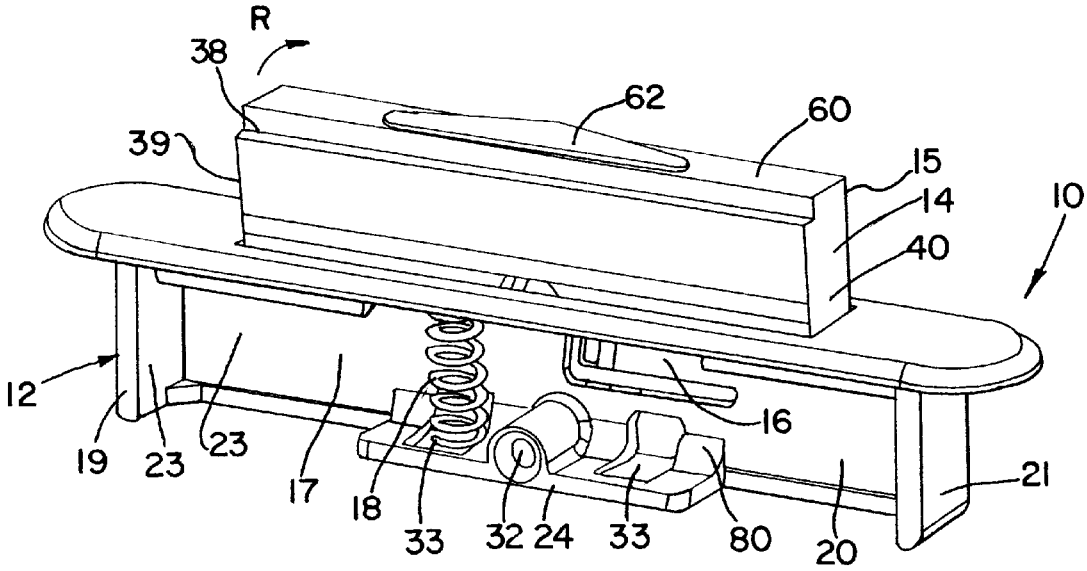
FIG. 7 is a perspective view of the window stop of FIG. 3 showing the bolt in a second posit and the internal cavity of the housing.

As the window stop 10 is installed in either a stile or track of a sliding window, the housing 12 is advantageously narrow to allow for such installation. As shown in FIGS. 6 and 7, the housing 12 has a cavity 20 that receives the bolt 14, means for securing the bolt 16, and means for biasing 18 the bolt 14. The housing 12 and cavity 20 are generally rectangle-shaped although other configurations such as square-shaped are possible. The housing 12 has a longitudinal axis, A. In addition, the housing 12 can be made of varying depths "D" and lengths "L" (FIG. 7) to accommodate installations with varying depths and clearances such as window tracks or sash stiles.

Figure 4:
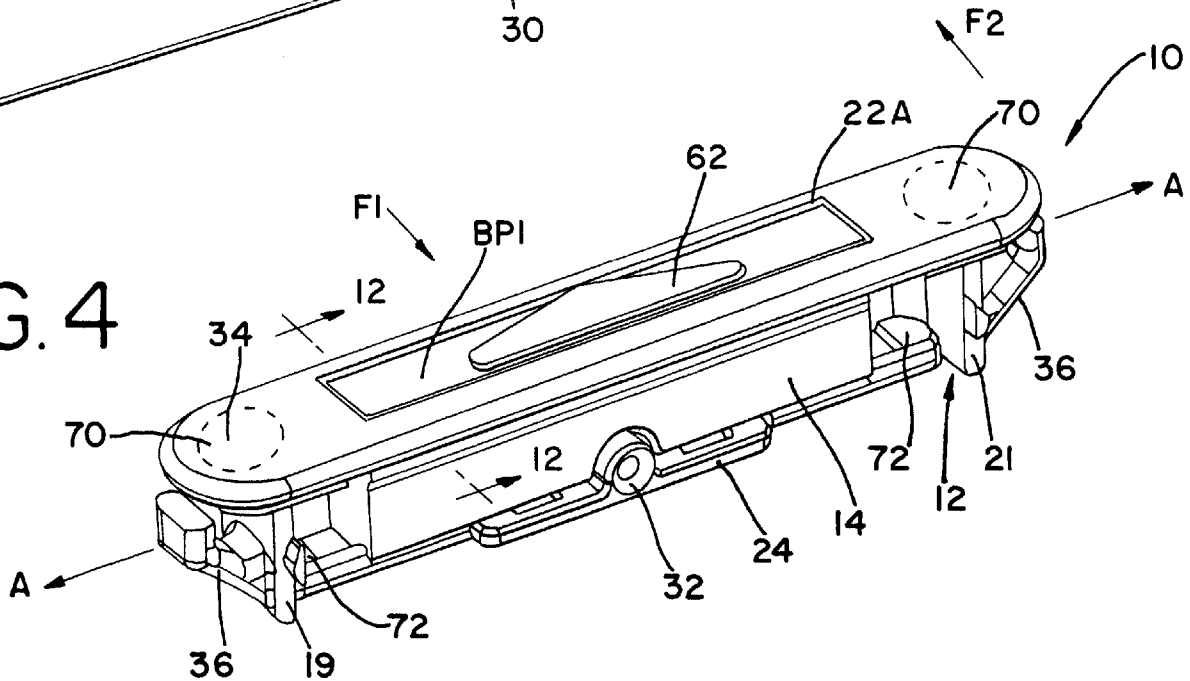
FIG. 4 is a perspective view of the window stop of FIG. 3 showing a housing and the bolt in the first position.

As shown in FIGS. 3 and 4, a top portion of the housing 12 has an opening 22*a* in communication with the cavity 20. The opening 22*a* allows the bolt 14 to extend therethrough to its second position BP2. Referring to FIGS. 6 and 7, the housing 12 has a back wall 17, a first side wall 19, and a second side wall 21. The housing 12 also has internal surfaces 23 that guide the bolt 14 as the bolt 14 extends from its first position BP1 to its second position BP2.

Figure 10:
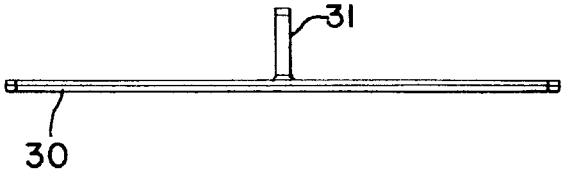
FIG. 10 is a top plan view of the window stop of FIG. 3 showing the cover plate and a pin extending from the cover plate.
Figure 11:
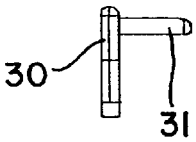
FIG. 11 is a side elevational view of the window stop of FIG. 3 showing the cover plate and the pin extending from the cover plate; and, FIG. 12 is a partial cross-sectional view of the window stop of FIG. 3 taken along line 12—12 of FIG. 3.
Figure 11:
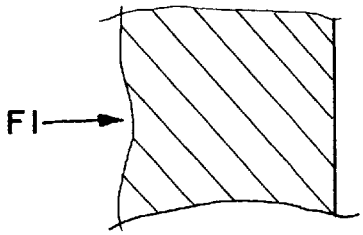

As shown in FIG. 3, the housing 12 also has a cover plate 30 that completely encloses the bolt 14 in the cavity 20 of the housing 12. The cover plate 30 is not shown in FIGS. 4–9 in order to show the internal structure of the window stop 10. A bottom portion of the housing 12 has a bottom wall 24. Preferably, the bottom wall 24 does not run the entire length L of the housing 12. As such, the housing 12 has at least one open area adjacent the bottom wall 24. This configuration can reduce the overall depth D of the stop 10 by allowing the bolt 14 to retract flush with the bottom wall 24 at its first position BP1. A reduction of the depth, D, can increase the number and type of installations for the stop 10, thereby increasing its utility and value. Conversely, the bolt 14 can be configured to have a greater length such as with legs that could extend through the openings in the bottom wall 24. The bottom wall 24 has a hole 32 to receive a pin 31 (FIGS. 10 and 11) extending from the cover plate 30. When the cover plate 30 is joined to the housing 12, the hole 32 receives the pin 31 in an interference fit to secure the cover plate 30 to the housing 12. The bottom wall 24 has a pad area 33, upon which the biasing means 18, preferably in the form of a coil spring, is placed and supported. Preferably, the pad 33 is a recessed portion of the bottom wall 24 and back wall 17. Alternatively, the pad 33 can be a number of configurations adapted to support the biasing means 18.

As further shown in FIGS. 3–9, a faceplate 34 is included with the housing 12. The faceplate 34 is a solid member integral with the housing 12. The length of the faceplate 34 can exceed the length L of the housing 12 and extends slightly forward of a track or stile of a sliding window so as not to interfere with the relative movement of the sliding window. The faceplate 34 has an opening 22*b* (FIG. 9) corresponding to the opening 22*a* of the cavity 20 to allow the bolt 14 to extend therethrough. The faceplate 34 has an interior surface 35 and a lip 37 that defines the opening 22*b*. The lip 37 can be generally smooth or contoured, depending on bolt 14 parameters. The peripheral edges of the faceplate 34 can be configured in a number of ways to facilitate mounting of the stop 10, including but not limited to rounded edges.

Figure 5:
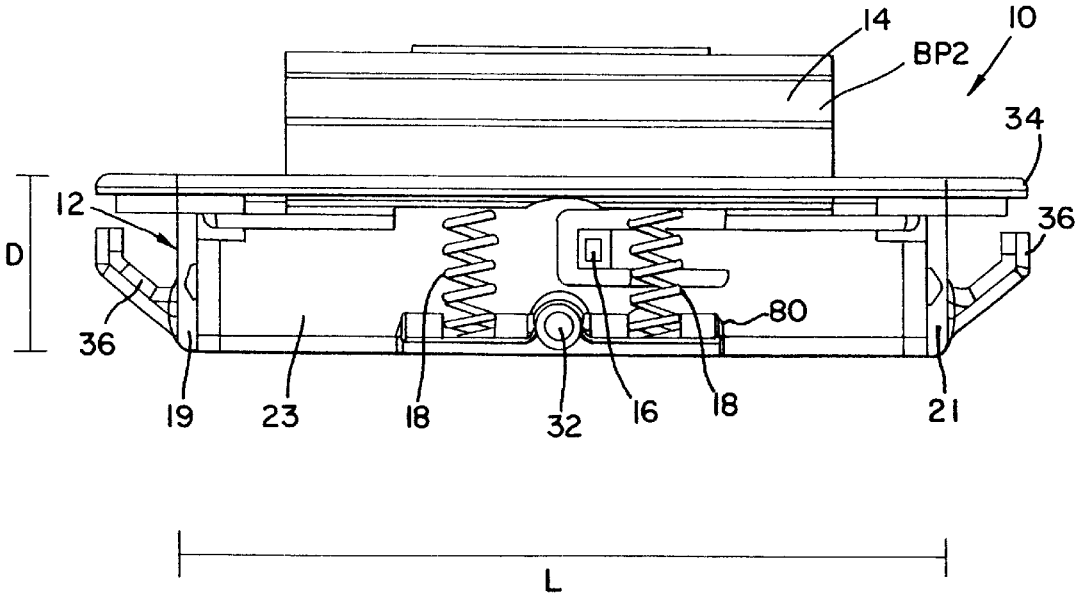
FIG. 5 is a side elevational view of the window stop of FIG. 3 showing the housing and the bolt in a second position.

To retain the housing 12 within a track or stile of a window frame, the housing 12 has a pair of clips 36 that fasten the housing 12 within the track or stile. As shown in FIGS. 4–6, the clips 36 are preferably flexible, resilient segments that snap into place at an underside surface of the track when the stop 10 is properly inserted in the track or stile of the window frame. Preferably, the clips 36 extend from the side walls 19,21 of the housing 12 outwardly and upwardly towards the faceplate 34. The clips 36 extend to a distance slightly greater than the expected thickness of the track or stile of the sliding window. Alternatively, the tabs clips 36 can take the form of a tab, prong, protrusion or any other suitable means.

Figure 12:
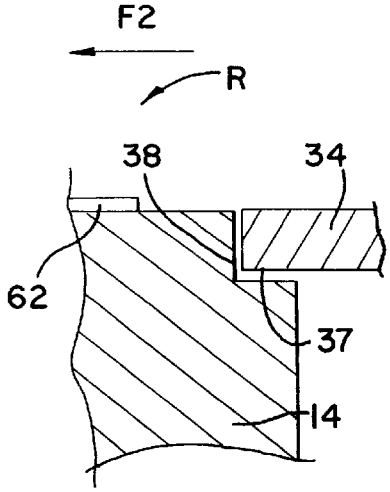

As shown in FIGS. 5–9, the bolt 14 is generally rectangle-shaped and configured to fit within the cavity 20 and internal surfaces 23 of the housing 12. An upper portion of the bolt has a recessed ledge 38 that extends longitudinally from a first end 39 of the bolt 14 to a second end 40 of the bolt 14. Preferably, the ledge 38 is continuous across the length of the bolt 14; however, the ledge 38 can be a discontinuous rail or segmented. The recessed ledge 38 can have a beveled surface or a flat surface. Referring to FIG. 12, when the bolt 14 is at the first position BP1, the recessed ledge 38 engages the lip 37 to prevent movement of the bolt 14 through the openings 22*a*, 22*b*.

Figure 8:
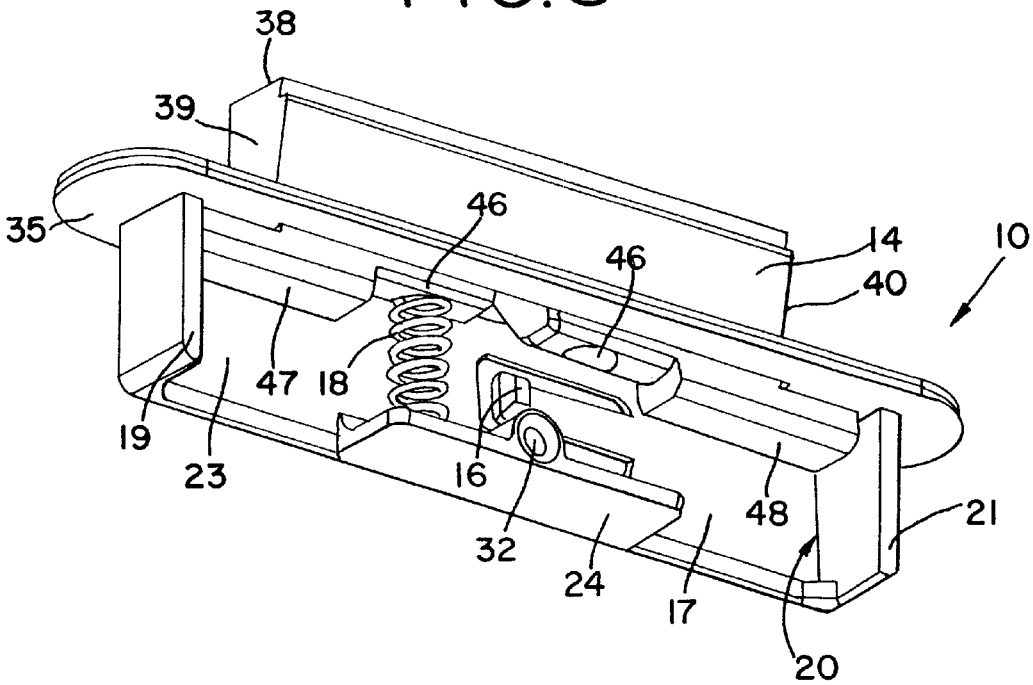
FIG. 8 is a perspective view of the window stop of FIG. 3 showing the bolt in a second position and an internal cavity of the housing.
Figure 9:
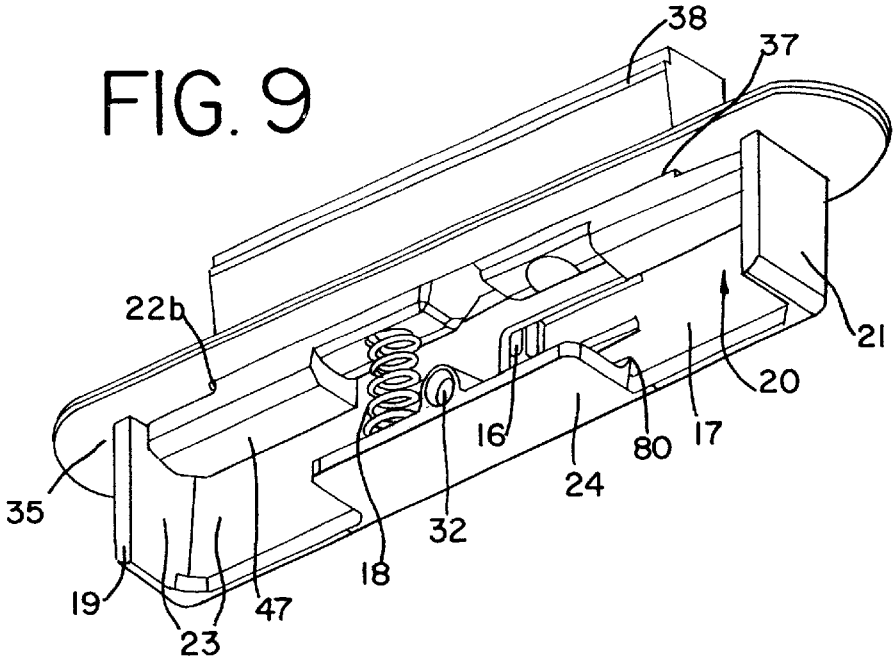
FIG. 9 is a perspective view of the window stop of FIG. 3 showing the bolt in a second position and an internal cavity of the housing.

Referring to FIGS. 8 and 9, within the bolt 14 are channels 46 to receive the springs 18. The channels 46 can be configured to extend the entire height of the bolt 14, or a portion of the bolt 14. Preferably, there are multiple channels; however, a single channel 46 configured to receive a single spring 18 is feasible. Each spring 18 is secured in place by the combination of the channel 46 and the pad 33. The bolt 14 further may have a core (not shown), which allows for sinkage or shrinkage of the plastic material of the bolt 14 during a cooling step of the injection molding process.

At a lower portion of bolt 14, a first bolt leg 47 extends towards the first side wall 19 and a second bolt leg 48 extends towards the second side wall 21. To ensure precise movement of the bolt 14 from the first position BP1 to the second position BP2, the bolt legs 47,48 are closely toleranced such that the bolt legs 47,48 are in cooperative sliding engagement with the respective side walls 19, 21.

As shown in FIGS. 5–9, the springs 18 are positioned between the bolt 14 and the housing 12 to bias the bolt 12 to its second position BP2. In a most preferred embodiment, a pair of springs 18 are used. Specifically, the springs 18 are positioned within channels 46 of the bolt 14, thereby being contained within the channels 46 when the bolt 12 is at first position BP1. Preferably, the springs 18 are coil springs; however, other types of springs could also be used. In addition, other types of resilient members such as those made from rubber material could be used to bias the bolt 14 to its second position BP2.

Referring to FIGS. 5–9, a means for securing 16 the bolt 14 is included in the back wall 15. In a most preferred embodiment, the securing means 16 is in the form of a resilient tab 16. The securing means 16 exerts a force generally perpendicular to the longitudinal axis A on a back surface 15 of the bolt 14. Thus, the securing means 16 exerts force in the general direction of the cover plate 30 from the back wall 17. To exert force generally perpendicular to the longitudinal axis A, the resilient tab 16 is biased towards that direction, or inward to the cavity 20. When the stop 10 is properly installed in either a stile or track of a sliding window, the securing means 16 exerts force generally perpendicular to the path of movement of the sliding window. Referring to FIGS. 3, 4 and 12, at the first position BP 1 the ledge 38 is engaged by the lip 37 and the resilient tab 16 exerts force on the bolt 14 in a direction generally perpendicular to the longitudinal axis A. Thus, the bolt 14 is retained at first position BP1 by the exertion of force by the securing means 16, or resilient tab 16, on the bolt 14 assuring that the recessed ledge 38 engages the lip 37. The securing means 18 can be a tab, prong, clip, or any other suitable structure capable of exerting force perpendicular to the longitudinal axis A. In addition, the back wall 17 can be structured to support a spring member to apply the force against the bolt 14 to bias the bolt 14 in a transverse direction wherein the recessed ledge will be forced in the transverse direction into the lip 37. The back wall 17 could also be molded such that it exerts suitable transverse force against the bolt 14.

When the bolt 14 is retained at first position BP1 by the securing means 16, the bolt 14 can only be disengaged or deployed to second position BP2 by applying a second force F2 generally transverse or perpendicular to the longitudinal axis A, in the opposite direction of a first force F1 exerted by the securing means 16. Since the securing means 16 is included in the back wall 15 and since it exerts force F1 in the general direction of the cover plate 30, the second force should be applied generally perpendicular to the longitudinal axis A in the direction of the back wall 15. Because a force generally perpendicular to the longitudinal axis A is used to help secure the bolt 14 at first position BP1 and because a force generally perpendicular to the longitudinal axis A is required to disengage the bolt 14 to deploy it to second position BP2, the lock 10 is considerably more resistant to accidental deployment than prior art designs. For the same reasons, the lock 10 is not susceptible to unexpected, inadvertent or unwanted deployment while the sliding window is moving along its path or line of movement.

Explained in the context of vectors, the force component of the second force F2 to disengage the bolt 14 must be greater than the force component of the first force F1 exerted by the securing means 16. In addition, the direction component of the second force F2 should be generally opposite the direction component of the first force F1. Thus, if the force component of the second force F2 exceeds the force component of the first force F1 and the second force is applied opposite the first force, then the recessed ledge 38 of the bolt 14 will be disengaged from the lip 37 of the housing 12 and deployed by the spring 18 to the second position BP2.

The housing 12 and bolt 14 have cooperating surfaces to help in the actuation of the bolt 14. As shown in FIGS. 5–7, the housing 12 has radiused surfaces 80 generally between the bottom wall 24 and the back wall 17. The bolt 14 has a radiused surface 82 on the rear wall 15 of the bolt 14 (FIG. 6). These radiused surfaces 80,82 generally correspond in shape and provide for cooperative sliding engagement. When the bolt 14 is actuated, the radiused surfaces 82 of the bolt slide along the radiused surfaces 80 of the housing 12 to assist in the smooth actuation of the bolt 14.

As shown in FIGS. 3, 4, and 7, a top surface 60 of the bolt 14 can have an indicia or tab 62 to indicate the location and/or direction of force to be applied to disengage the bolt 14 from the first position BP1. Preferably, a user would apply the second force F2 in the direction and location indicated by tab 62. The tab 62 could be an arrow, a series of arrows, or raised material.

To ensure the precise application of force by the securing member 16, a back surface of the bolt 14 can have a vertically oriented channel (not shown) positioned adjacent the securing member 16. The securing means 16 would be in cooperative sliding engagement with the channel as the bolt 14 is deployed from the first position BP1 to the second position BP 2. The channel and the securing member 16 should be closely toleranced to ensure proper sliding engagement between the components.

To ensure stability of the bolt at second position BP2, the housing 12 and bolt 14 can have engaging surfaces in the form of a series of tongue and groove arrangements. The tongue and groove arrangements transfer forces from the bolt 14 to the housing 12 when the extended bolt (BP2)

receives forces from contact with the sliding window. The housing 12 can have housing tongues located towards opposite ends of the cavity 20. The bolt 14 can have bolt grooves located towards opposite ends of the bolt 14 at a bottom end of the bolt 14. The housing tongues are configured to cooperate with the bolt grooves when the bolt 14 is extended to its second position BP2.

To further ensure the stability of the bolt 14 at second position BP2, the housing 12 can have a pair of housing grooves 70 (shown in phantom in FIG. 4) located at an underside of the plate. As further shown in FIG. 4, the bolt 14 has bolt tongues 72 located on the legs and adapted to fit into the grooves 70 when the bolt is in the extended position BP2. The housing grooves are configured to cooperate with the bolt tongues when the bolt 14 is extended to its second position BP2. Thus, when the bolt 14 extends to its second position BP2 (FIGS. 5–9), the housing grooves 70 cooperate with bolt tongues 72. These engaging surfaces provide additional surface area over which forces from contact with a sliding window may be transferred from the bolt 14 to the housing 12. It is understood that a single tongue and groove arrangement could be used as well as a single arrangement on only one side of the window stop 10. It is preferred, however, that a pair of engaging surfaces be used to maximize the strength and stability of the window stop 10.

In addition, the housing 12, and bolt 14 are all manufactured to very close tolerances. The parts interfit very closely to increase the already large and resistive areas over which forces may be transferred. Also, the housing 12 and bolt 14 are molded of a high strength, high impact resistant plastic material, such as polycarbonate.

To assemble the window stop 10, the bolt 14 is first inserted into the opening 22 through the cavity 20. The bolt 14 is then inserted into the opening 20 of the housing 12. The biasing means 18 are then inserted into the channels 46 of the bolt 14 and positioned on the pads 33. Finally, the cover plate 30 is joined to the housing 12 in an interference fit to enclose the bolt 14 in the housing 12. A unitary structure is thus formed. The window stop 10 is then ready for shipment and installation into a window assembly by a window manufacturer.

Installation And Operation

Although the specific installation of the window stop 10 into a window frame is not shown, it can be readily understood from FIGS. 3–12. The window stop 10 can be installed into an opening either in a stile of a window frame of a double-hung window or a window track of a horizontal sliding window. As the window stop 10 is inserted into the opening, the fastening means 36 on the housing 12 flex inwardly to allow the housing 12 to fit into the opening. Once the fastening means 36 move past the opening, they spring back underneath the relatively thin material in a hollow sash construction or against edges of a recess in a solid sash construction.

Once installed adjacent to the sliding window, the window stop 10 can be operated to limit movement of the sliding window. The window stop 10 is first configured as shown in FIGS. 3 and 4, where the bolt 14 is in its first position BP1, out of the path of sliding window movement, and preferably flush with the faceplate 34 for enhanced appearance. In the first position BP 1 the securing means 16 exerts a first force F1 generally perpendicular to the longitudinal axis A on the bolt 14 while the recessed ledge 38 engages the lip 37. In the first position BP1, the bolt 14 is retained within the housing 12.

When it is desired to limit movement of the sliding window, the bolt 14 must be deployed from the first position BP1 to the second position BP2 by applying a second force F2 in a direction generally perpendicular to the longitudinal axis A and towards the back wall 15. To successfully disengage the bolt 14 from first position BP1, the amount of the second force F2 must be greater than the amount of the first force F1 exerted by the securing means 16. If an insufficient amount of second force F2 is applied, then the bolt 14 will remain at the first position BP1. Once a sufficient amount of second force F2 is applied to the bolt 14, the bolt 14 is displaced in the direction of the second force F2 and the ledge 38 gains clearance from the lip 37. The bolt 14 rotates slightly (in the direction of arrowR, FIGS. 7 and 12) with the aid of the recessed surfaces 80,82 between the bolt 14 and the housing 12 which helps the ledge 38 gain clearance from the lip 37. Once the ledge 38 gains clearance from the lip 37, the lip 37 no longer obstructs movement of the bolt 14 and the bolt 14 is displaced by the biasing means 18 through the opening 22 and to the second position BP2. The securing means 16 constantly exerts force generally perpendicular to the longitudinal axis A, meaning that the securing means 16 exerts force while the ledge 38 clears the lip, while the bolt 14 is displaced through the opening 22, and while the bolt is deployed at the second position BP2.

Preferably, when the bolt 14 is deployed at the second position BP2 it has an extension of at least ⅜ inches from the stile or track of a window frame. In this position, the bolt 14 is in the path of sliding window movement. It is understood the different extension lengths of the bolt 14 are possible.

With the bolt 14 extended to its second position BP2, the bolt legs 48 engage the sidewalls 19, 21 and the bolt tongues 72 are received by the housing grooves 70. This construction gives the bolt 14 increased stability when in its second position BP2. When a sliding window contacts the bolt 14, sometimes at high impact, the bolt legs 48 transfer the forces received from the sliding window from the bolt 14 through the sidewalls 19, 21 to remaining portions of the housing 12. Because these bolt legs 48 provide a larger resistive area over which forces may be transferred, the window stop 10 of the present invention is able to absorb higher forces from sliding windows than the conventional window lock having the rotating tumbler or actuator. In addition, the bolt 14 extends directly out of the housing along a linear axis rather than rotating out of the housing like a tumbler. Therefore, tumbler over-rotation is eliminated. When it is no longer desired to limit movement of the sliding window, the bolt 14 is returned to its first position BP1 by pushing the bolt back into the housing 12 through opening 22. As the bolt 14 is pushed into the housing 12 against the outward bias of the spring 58 and against the generally perpendicular exertion of force by the securing means 16, the lip 37 engages the ledge 38 and the bolt 14 returns to and is maintained in the first position BP1. When it is again desired to limit movement of the sliding window, the window stop is again operated as described above.

Thus, an improved window stop is provided. Because the housing 12 only requires a single cavity 20, the window stop is very compact in size and its utility and value are quite high. Since the bolt 14 can only be deployed from the first position BP1 to the second position BP2 by application of a force greater than the force exerted by the securing means 16 and directed generally perpendicular to the longitudinal axis and towards the securing means 16, the lock 10 is highly reliable and not prone to unexpected deployment. The bolt legs 47 and the tongue and groove arrangements between the housing 12 and bolt 14 allow the window stop 10 to absorb increased forces from contact with the sliding window thereby increasing its useful life and its possible applications. Furthermore, as shown above, the window stop is easy to operate. An important application of the stop of the present invention is for limiting the movement of sliding windows. It is appreciated, however, that the stop could also be used to limit the movement of other types of sliding members, other than sliding windows. Furthermore, it is appreciated that the bolt 14 serves as both the structure to limit movement of a sliding member and the actuator to deploy the bolt to the second position BP2. The rotational movement of the bolt 14 actuates the bolt 14 to the second position BP2. Accordingly, a separate actuator element, such as in U.S. Pat. No. 5,806,900 is eliminated saving in parts costs and improving the simplicity of the construction of the window stop. It is also understood that the dimensions of the recessed ledge 38 could be varied which will also vary the force required to actuate the bolt 14.

While particular embodiments of the invention have been shown and described, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes and modifications as fall within the true spirit and scope of the invention.

I claim:

1. A window stop for limiting movement of a sliding window along a predetermined path of window movement, the window stop comprising:

a housing having a cavity, the housing positioned such that the housing is generally parallel to the path of window movement;

a bolt operatively associated with the cavity and moveable between a first position within the housing and thereby out of the path of window movement and a second position extending out of the housing into the path of the window movement whereby the window is able to contact an engaging surface of the bolt;

means for securing the bolt in its first position wherein a force is applied to the bolt in a direction generally transverse to a longitudinal axis of the housing and wherein the bolt is moved in a direction generally parallel to the engaging surface to permit movement of the bolt from the first position to the second position; and, a first means for biasing the bolt towards its second position wherein the bolt receives forces from the window contacting the bolt in its second position.

2. The window stop of claim 1 wherein an upper portion of the bolt has a ledge, wherein an upper portion of the housing has a lip, and wherein at the first position, the securing means applies a force to a surface of the bolt to retain the bolt while the lip engages the ledge.

3. The window stop of claim 1 wherein an upper portion of the bolt has a recessed ledge, wherein an upper portion of the housing has an interior surface, and wherein at the first position, the securing means applies a force to a surface of the bolt to secure the bolt while the interior surface engages the ledge.

4. The window stop of claim 3 wherein the bolt is operable from outside of the cavity.

5. The window stop of claim 3 wherein the bolt and housing have engaging surfaces, the engaging surface comprising a tongue and groove arrangement wherein a tongue is located either on the bolt or the housing and a cooperating groove is located either on the housing or bolt to absorb and transfer forces between the window, bolt, and housing.

6. The window stop of claim 5 wherein the first biasing means is positioned between the housing and the bolt.

7. The window stop of claim 6 including a second means for biasing the bolt towards the second position.

8. The window stop of claim 7 wherein the second biasing means is positioned between the housing and the bolt.

9. The window stop of claim 8 wherein the first biasing means and the second biasing means are springs.

10. The window stop of claim 9 including a pair of channels in the bolt to receive a respective one of the biasing means.

11. The window stop of claim 9 wherein the securing means is a tab affixed to a wall of the housing and biased towards the cavity.

12. The window stop of claim 3 including a means for fastening the stop in an opening in a window stile, the fastening means extending upwardly from a side wall of the housing to engage the window stile.

13. The window stop of claim 12 wherein the fastening means is a pair of flexible tabs.

14. The window stop of claim 3 including an indicia on an upper surface of the bolt, the indicia indicating that force must be applied in a direction generally transverse to the longitudinal axis of the housing to release the bolt from the first position.

15. A window stop for limiting movement of a sliding window along a predetermined path of window movement, the window stop comprising:

a housing having a cavity, the housing adapted to be positioned in a support member supporting the sliding window, an upper portion of the housing having an interior surface;

a bolt operatively associated with the cavity and moveable between a first position wherein the bolt is generally within the housing, and a second position wherein a portion of the bolt extends beyond the housing into the path of the window movement, an upper portion of the bolt having a recessed ledge;

means for securing the bolt in its first position wherein the securing means applies a force to the bolt while the interior surface engages the ledge, the force applied in a direction generally transverse to a longitudinal axis of the housing; and, a first means for biasing the bolt towards its second position wherein a portion of the bolt receives forces from the window contacting the bolt in its second position, wherein the bolt and housing have engaging surfaces, the engaging surfaces comprising a tongue and a cooperating groove arrangement wherein the tongue is positioned on either the bolt or the housing and the cooperating groove is positioned on either the housing or bolt to absorb and transfer forces between the window, bolt, and housing.

* * * * *